US009649867B2

(12) United States Patent
Imanishi

(10) Patent No.: US 9,649,867 B2
(45) Date of Patent: May 16, 2017

(54) IMAGE-FORMING APPARATUS AND IMAGE-FORMING METHOD

(71) Applicant: Konica Minolta, Inc., Chiyoda-ku, Tokyo (JP)

(72) Inventor: Kazuhiko Imanishi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/108,423

(22) PCT Filed: Dec. 16, 2014

(86) PCT No.: PCT/JP2014/083197

§ 371 (c)(1),
(2) Date: Jun. 27, 2016

(87) PCT Pub. No.: WO2015/098607

PCT Pub. Date: Jul. 2, 2015

(65) Prior Publication Data

US 2016/0318323 A1 Nov. 3, 2016

(30) Foreign Application Priority Data

Dec. 27, 2013 (JP) ..... 2013-270887

(51) Int. Cl.
*B41J 29/393* (2006.01)
*B41J 29/42* (2006.01)
(Continued)

(52) U.S. Cl.
CPC ..... *B41J 29/393* (2013.01); *B41J 11/008* (2013.01); *B41J 29/42* (2013.01); *B41J 2/2142* (2013.01); *B41J 2/2146* (2013.01)

(58) Field of Classification Search
CPC ..... B41J 2/2142; B41J 2/2146; B41J 11/008; B41J 29/393; B41J 29/42; G03G 2215/00569
See application file for complete search history.

(56) References Cited

U.S. PATENT DOCUMENTS 8,027,610 B2 * 9/2011 Yamazaki ..... G03G 15/238 399/13
2004/0109176 A1 * 6/2004 Osari ..... G06K 15/02 358/1.2

FOREIGN PATENT DOCUMENTS

JP H07137290 A 5/1995
JP 2010058361 A 3/2010
JP 2011212932 A 10/2011

OTHER PUBLICATIONS

International Search Report corresponding to Application No. PCT/JP2014/083197; Date of Mailing: Feb. 3, 2015, with English translation.

(Continued)

*Primary Examiner* — Anh T. N. Vo
(74) *Attorney, Agent, or Firm* — Cantor Colburn LLP

(57) ABSTRACT

The present invention is provided with an image-forming unit for forming an image on a recording medium, and a control unit for controlling the formation by the image-forming unit of a test image used for adjustment of the image-forming unit in a blank space portion in which an image is not formed on the recording medium, the control unit specifying the size of the blank space portion, and forming a test image corresponding to the size of the blank space portion in the blank space portion. The test image is thus formed adequately utilizing the blank space of the recording medium.

12 Claims, 7 Drawing Sheets

(51) Int. Cl.
*B41J 11/00* (2006.01)
*B41J 2/21* (2006.01)

(56) References Cited

OTHER PUBLICATIONS

International Preliminary Report on Patentability corresponding to Application No. PCT/JP2014/083197; Date of Mailing: Jun. 28, 2016, with English translation.
Written Opinion of the International Searching Authority corresponding to Application No. PCT/JP2014/083197; Date of Mailing: Feb. 3, 2015, with English translation.
Chinese Notification of the First Office Action corresponding to Application No. 201480070270.8; Date of Mailing: Dec. 5, 2016, with English translation.

* cited by examiner

IMAGE-FORMING APPARATUS AND IMAGE-FORMING METHOD

This is the U.S. national stage of application No. PCT/JP2014/083197, filed on Dec. 16, 2014. Priority under 35 U.S.C. §119(a) and 35 U.S.C. §365(b) is claimed from Japanese Application No. 2013-270887, filed Dec. 27, 2013, the disclosure of which is also incorporated herein by reference.

FIELD OF INVENTION

The present invention relates to an image forming apparatus and an image forming method.

BACKGROUND ART

Image forming apparatuses have been known which form an image on a recording medium based on an image data and also form a test image for image adjustment in the margin of the recording medium where the image is not formed. The test image is a pattern image such as a test chart for example, and such test images enable detecting errors in image forming such as clogging of nozzles that jet ink to form an image.

For example, Patent Document 1 proposes dividing a test image into parts and forming them respectively in upper and lower margins in the conveying direction of a recording medium during image formation, so as to form the whole test image required for the recording medium.

PRIOR ART DOCUMENT

Patent Document

Patent Document 1: JP 2010-58361A

SUMMARY OF INVENTION

Problems to be Solved by Invention

However, in the technique of Patent Document 1, the area required for forming the test image and the area of the margin are not considered. Even when the margin remains partly unused after the test image is formed in the margin, the unused part is left blank. Therefore, a problem with this technique is that the margin of a recording medium is not adequately utilized.

It is an object of the present invention to provide an image forming apparatus and an image forming method that can adequately utilize the margin of a recording medium for forming a test image.

Means for Solving Problems

In order to achieve the object, the invention described in claim 1 is an image forming apparatus, including:

an image forming section which forms an image on a recording medium; and a control section which controls the image forming section to form a test image for an adjustment of the image forming section in a margin of the recording medium where the image is not formed, wherein the control section determines a size of the margin and forms the test image in the margin in a size corresponding to the size of the margin.

The invention described in claim 2 is the image forming apparatus according to claim 1, wherein the control section compares the size of the margin with a size of a predetermined pattern image, and if it is determined that the size of the margin is smaller than the size of the predetermined pattern image, the control section divides the predetermined pattern image so as to obtain a part corresponding to the size of the margin and performs a control so that the part of the divided predetermined pattern image is formed in the margin as the test image.

The invention described in claim 3 is the image forming apparatus according to claim 2, wherein the control section performs a control so that a remaining part of the divided predetermined pattern image is formed in a margin of a subsequent recording medium as the test image.

The invention described in claim 4 is the image forming apparatus according to any one of claims 1 to 3, further including:

a storage section in which different pattern images are stored, wherein the control section compares the size of the margin with a size of a predetermined pattern image, and if it is determined that the size of the margin is larger than the size of the predetermined pattern image, the control section selects the predetermined pattern image and another pattern image other than the predetermined pattern image from among the different pattern images stored in the storage section according to the size of the margin and forms the predetermined pattern image and the another pattern image in the margin as the test image.

The invention described in claim 5 is the image forming apparatus according to claim 4, wherein the control section divides at least one pattern image of pattern images to be formed in the margin as the test image so as to obtain a part of a predetermined size and then performs a control so that the part of the divided pattern image is formed in the margin as the test image, and a remaining part of the divided pattern image is formed in a margin of a subsequent recording medium as the test image.

The invention described in claim 6 is the image forming apparatus according to claim 1, further including:

a storage section in which different pattern images are stored, wherein the control section selects a pattern image to be formed in the margin as the test image from among the different pattern images stored in the storage section according to the size of the margin.

The invention described in claim 7 is the image forming apparatus according to any one of claims 4 to 6, wherein the image forming section comprises one or a plurality of recording head units each comprising at least one recording head with nozzles, and wherein the different pattern images respectively designed for the recording head or the recording head units are stored in the storage section.

The invention described in claim 8 is the image forming apparatus according to claim 7, further including:

a second storage section which stores information on the recording head and the recording head units, wherein the control section determines the pattern image to be formed in the margin as the test image from among the different pattern images stored in the storage section according to the information.

The invention described in claim 9 is the image forming apparatus according to any one of claims 1 to 8, wherein the control section changes a size of the test image according to a size of an image forming area in the recording medium.

The invention described in claim 10 is the image forming apparatus according to any one of claims 1 to 9, wherein the control section determines the test image according to a content of the image to be formed in an image forming area in the recording medium.

The invention described in claim 11 is the image forming apparatus according to claim 10, further including:

a reading section which reads the test image formed in the margin, wherein the reading section changes a reading area of the test image according to a size of the image forming area in the recording medium.

The invention described in claim 12 is an image forming method, which is performed in an image forming apparatus comprising an image forming section configured to form an image on a recording medium, including:

a test image forming step of determining a size of a margin of the recording medium where the image is not formed and controlling the image forming section to form a test image for an adjustment of the image forming section in the margin in a size corresponding to the size of the margin.

Advantageous Effects of Invention

With the present invention, the margin of a recording medium can be adequately utilized for forming a test image.

EMBODIMENTS FOR CARRYING OUT INVENTION

Hereinafter, an embodiment of the present invention will be described with the drawings. While the following embodiment is defined by a variety of limitations that are technically preferable for carrying out the present invention, the scope of the present invention is not limited to the following embodiment and the depicted examples.

Figure 1:
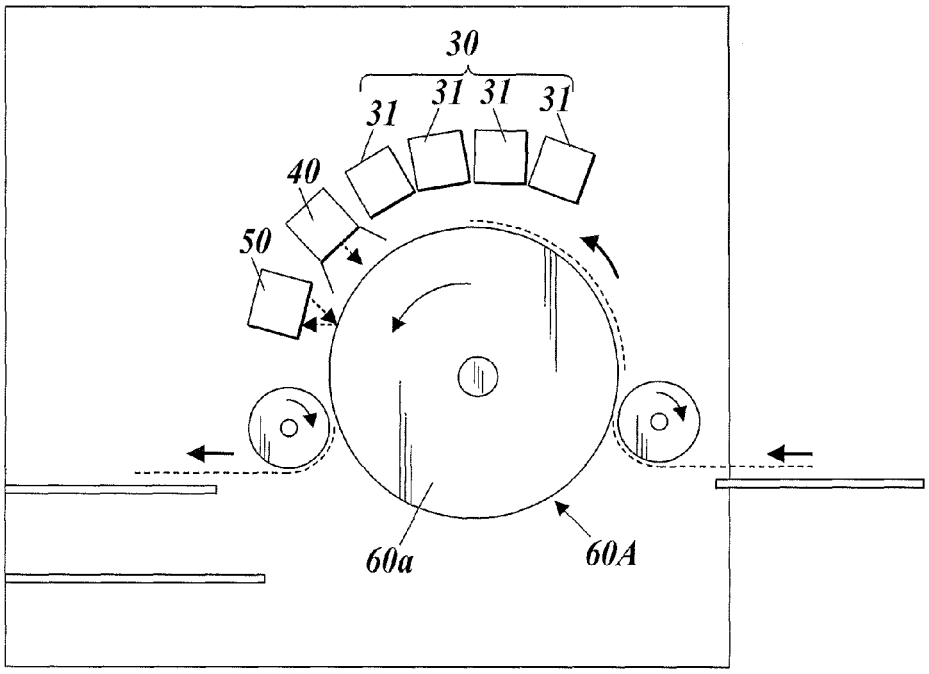
FIG. 1 illustrates the main configuration of an image forming apparatus according to an embodiment of the present invention.

FIG. 1 illustrates the main configuration of an image forming apparatus 1 according to the embodiment of the present invention.

Figure 2:
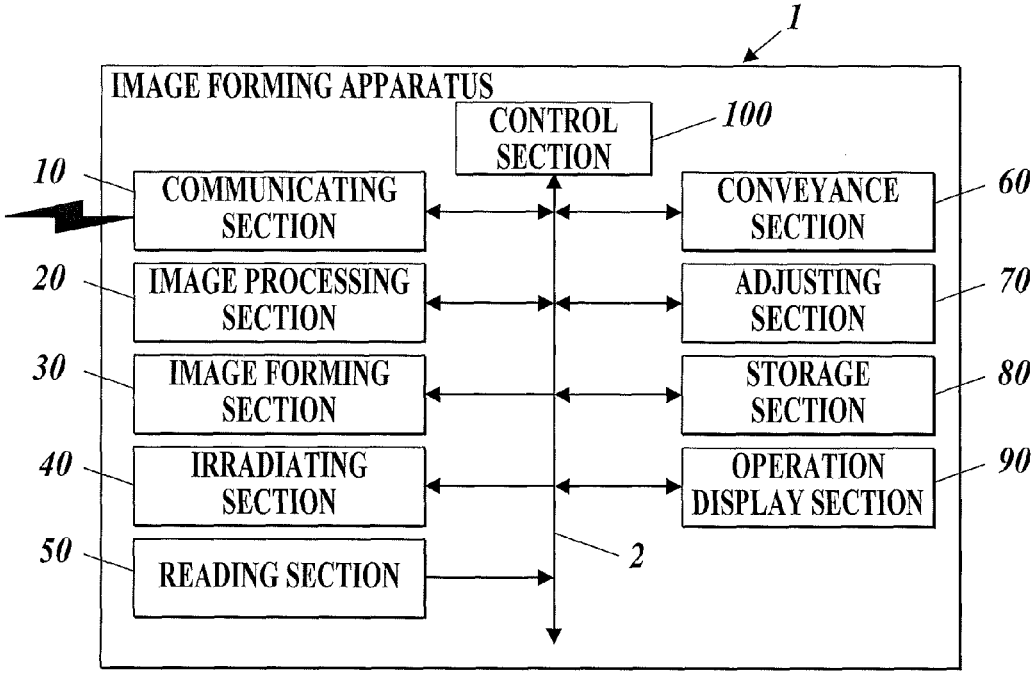
FIG. 2 is a block diagram illustrating the main configuration of the image forming apparatus.

FIG. 2 is a block diagram illustrating the main configuration of the image forming apparatus 1.

The image forming apparatus 1 includes a communicating section 10, an image processing section 20, an image forming section 30, an irradiating section 40, a reading section 50, a conveyance section 60, an adjusting section 70, a storage section 80, an operation display section 90, a control section 100 and the like. These sections are connected to one another via a bus 2.

The communicating section 10, which includes a network interface card and the like for example, connects the image forming apparatus 1 to an external device so that communication between them is possible.

The communicating section 10 receives, for example, a job data sent from an external device.

The image processing section 20 performs a variety of image processing.

Specifically, the image processing section 20 performs, for example, analysis processing for analyzing a data in a page description language included in a job data input through the communicating section 10 so as to generate a vector data, rasterization processing for generating a bit map data of the image data from the vector data generated in the analysis processing and the like.

The image forming section 30 forms an image on a recording medium P.

Specifically, the image forming section 30 includes, for example, a recording head unit 31 that includes at least one recording head with nozzles aligned in a predetermined direction.

The image forming section 30 forms an image on a recording medium P by jetting ink to the recording medium P conveyed by means of the conveyance section 60 through the nozzles of the recording head of the recording head unit 31 based on the bit map data generated by the image processing section 20.

The image forming section 30 of this embodiment can perform color printing in which an image is formed by using a combination of different color inks (e.g. cyan (C), magenta (M), yellow (Y) and black (K)). The recording head unit 31 of the image forming section 30 is individually provided for each of the different colors. In this embodiment, four recording head units 31 are provided, but the number thereof is not limited thereto.

For example, the image forming section 30 forms an image according to a job data in an image forming area of the recording medium P.

Figure 3:
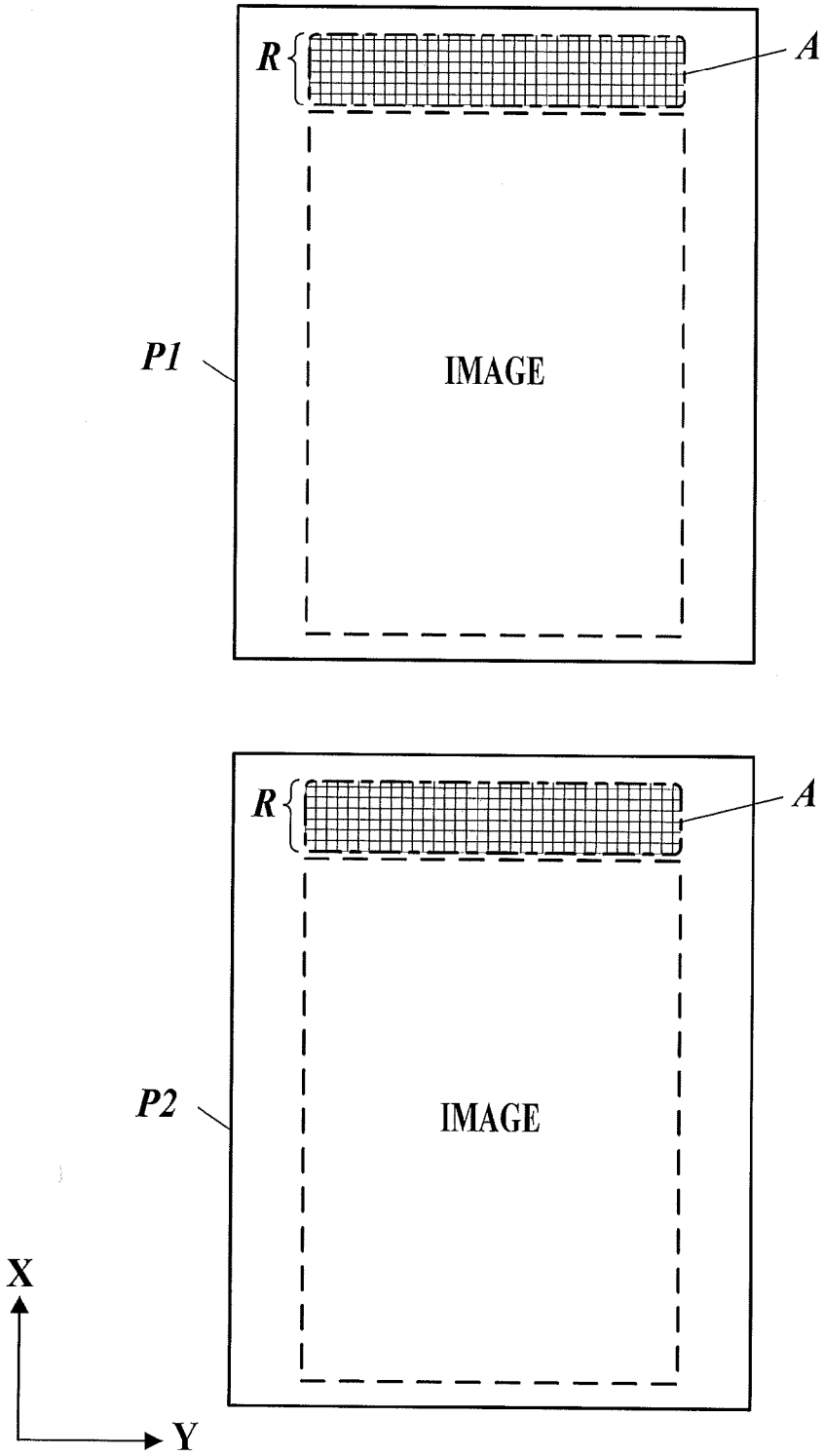
FIG. 3 illustrates an example of a recording medium on which a test image is formed.
Figure 4:
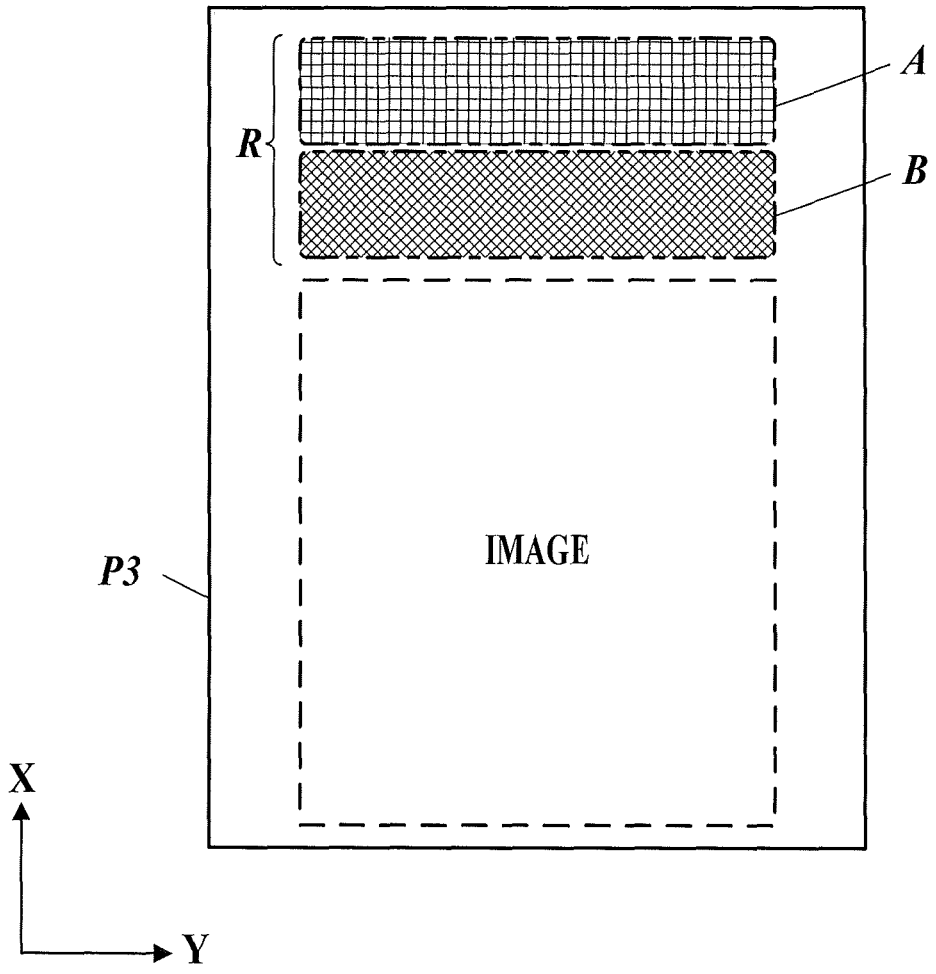
FIG. 4 illustrates an example of a recording medium on which a test image is formed.
Figure 5:
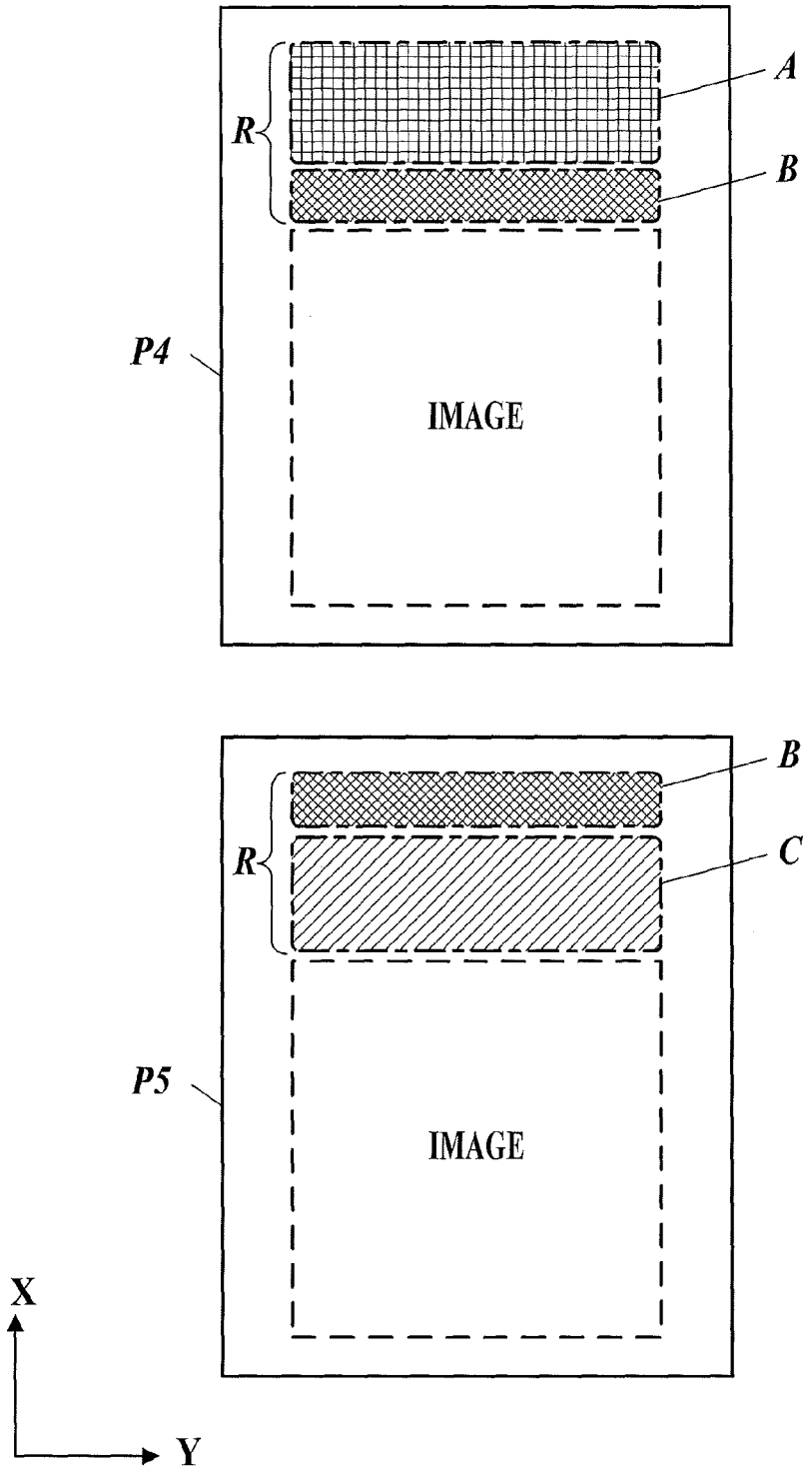
FIG. 5 illustrates an example of a recording medium on which a test image is formed.

In addition to the image according to the job data, the image forming section 30 also forms a test image in the margin R of the recording medium P (see FIG. 3 to FIG. 5). In this embodiment, the test image is formed in a size corresponding to the size of the margin R according to the size of the margin R. For example, the test image is composed of a part or all of a single pattern image or a combination of different pattern images. The details of test image formation processing will be described below.

The irradiating section 40 irradiates the recording medium P on which an image has been formed by the image forming section 30 with an energy for fixing the image.

The energy emitted from the irradiating section 40 is selected according to the properties of the inks. For example, when ultraviolet curable inks that cure by irradiation with an ultraviolet ray are used in the recording head unit 31 of the image forming section 30, the energy that the irradiating section 40 emits is an ultraviolet ray. In this case, the irradiating section 40 includes an irradiation source that emits ultraviolet (UV) ray such as a light emitting diode (LED), and the like. The irradiating section 40 irradiates the recording medium P conveyed by the conveyance section 60 with an ultraviolet ray.

When the recording medium P is irradiated with the energy by means of the irradiating section 40, the inks jetted on a recording face of the recording medium P cures and are thus fixed on the recording face.

The reading section 50 reads an image on a recording medium P.

Specifically, the reading section 50 includes, for example, a linear imaging sensor with a predetermined number of imaging elements aligned in a predetermined direction such as a CCD (charge-coupled device) imaging sensor and a CMOS (complementary metal oxide semiconductor) imaging sensor, a generating unit that generates an image data according to electric signals output from the imaging elements, a light source that irradiates the recording medium P with light, and the like. The reading section 50 reads an image on the recording medium P by scanning the recording medium P that moves relative to the reading section 50 by being conveyed by the conveyance section 60. More specifically, the reading section 50 irradiates the recording medium P with a light from the light source, detects the light reflected on the recording medium P by means of the linear imaging sensor, generates an image data (read image data) based on electric signals output as the detection result and outputs the image data as the scanning result.

The conveyance section 60 conveys the recording medium P to the image forming section 30, the irradiating section 40 and the reading section 50.

Specifically, the conveyance section 60 includes, for example, a cylindrical drum 60*a*. The drum 60*a* is disposed rotatably around the axis through the center of the circle of the cylinder. The drum 60*a* supports the recording medium P on the cylindrical outer circumferential face thereof. The conveyance section 60 rotates the drum 60*a* so as to convey the recording medium P supported on the outer circumferential face such that one side of the recording medium P faces the image forming section 30, the irradiating section 40 and the reading section 50.

The image forming section 30, the irradiating section 40 and the reading section 50 are disposed in the vicinity of where the rotating outer circumferential face of the drum 60*a* passes through and are arranged along the outer circumferential face. Specifically, as illustrated in FIG. 1, the image forming section 30, the irradiating section 40 and the reading section 50 are disposed in the part of the conveyance path of the recording medium P that is located on the outer circumferential face of the drum 60*a* and are arranged in the order of the image forming section 30, the irradiating section 40 and the reading section 50 from the upstream to the downstream.

The conveyance section 60 further includes a detecting unit (not shown) that detects the rotation angle of the drum 60*a*. The conveyance section 60 is capable of detecting the position of the recording medium P that is being conveyed and supported on the outer circumferential face of the drum 60*a* from the detected rotation angle of the drum 60*a* detected by the detecting unit. The detecting unit is constituted by, for example, an encoder disposed at the rotation shaft of the drum 60*a*. However, it is merely an example, and the detecting unit may have any configuration that enables detecting the rotation angle of the drum 60*a*.

The conveyance section 60 may have a mechanism (switchback mechanism) that flips over the recording medium P. By the switchback mechanism flipping over the recording medium P, the conveyance section 60 can convey a medium such as the recording medium P such that the two sides thereof sequentially face the image forming section 30. When the recording medium P is flipped over during the conveyance by means of the switchback mechanism, test images can be formed on both sides of the recording medium P.

The adjusting section 70 makes a determination as to whether the color reproducibility of the image forming section 30 is OK based on the result of comparisons between different colors in a test image and corresponding different colors in the result of reading the test image by the reading section 50. The adjusting section 70 then performs an adjustment relating to the color reproduction of the image forming section 30 based on the determination result.

Specifically, the adjusting section 70 compares the colors of the original image data of the test image with the colors of the read image data. That is, for example, the adjusting section 70 compares the color value of each pixel of the original image data of the test image with the color value of the each pixel of the read image data. Then, when there is a difference between the compared color values, the adjusting section 70 makes a determination as to whether the color reproducibility of the image forming section 30 is OK based on the relation between the difference and a predetermined threshold. If it is determined that the color reproducibility of the image forming section 30 is not OK, the adjusting section 70 performs an adjustment to adjust the output signal so that colors are correctly reproduced.

The adjusting section 70 is constituted by, for example, an integrated circuit such as a PLD or an ASIC or a circuit composed of a combination of such integrated circuits, and the functions of the adjusting section 70 are implemented in the circuit. However, it is merely an example, and the adjusting section 70 is not limited thereto. For example, individual circuits may be provided for all or a part of the functions.

The storage section 80 is constituted by a data-readable/writable semiconductor memory or the like. In the storage section 80, image data of different pattern images, which are original image data of test images, are stored.

For example, the different pattern images are designed respectively for the recording heads provided in each recording head unit 31 or for recording head units 31. However, the variety of the pattern images is not limited thereto.

Further, the different pattern images are formed on the recording medium P in a predetermined order (output order).

The operation display section 90 performs various display outputs relating to the operation of the image forming apparatus 1 and also detects various input operations relating to the operation of the image forming apparatus 1.

Specifically, the operation display section 90 includes, for example, a display device with a touch-panel input device, a switch for various input operations, and the like. The operation display section 90 performs various display outputs relating to the operation of the image forming apparatus 1 by a control of the control section 100. Further, the operation display section 90 detects a user input operation performed on the touch-panel input device or the switch, and outputs a signal according to the detected input operation to the control section 100.

The control section 100 performs various processing for controlling the operation of the image forming apparatus 1.

Specifically, the control section 100 includes, for example, a CPU (central processing unit), a RAM (random access memory), a ROM (read only memory) and the like. The CPU reads out and processes a program, a data and the like related to the processing from a storage device such as the ROM, so as to control the operation of the components of the image forming apparatus 1. Further, the CPU makes the RAM store the program and data that have been read out for the processing, parameters that are generated in the processing, and the like.

Hereinafter, a specific operation of the image forming apparatus 1 will be described.

The image forming apparatus 1 of this embodiment forms an image on the recording medium P and also forms a test image in the margin R of the recording medium P by means of the image forming section 30. Then, it reads the test image formed on the recording medium P by means of the reading section 50 and performs an adjustment by means of the adjusting section 70.

In the formation of the test image, the control section 100 determines the size of the margin R of the recording medium P and performs a control so that the test image is formed in the margin R in a size corresponding to the size of the margin R. As described above, the test image of this embodiment is composed of, for example, a part or all of a single pattern image or a combination of different pattern images.

FIG. 3 illustrates an example in which a single pattern image (pattern A) is divided and formed in the margins R of two recording media P (P1, P2). That is, in FIG. 3, each of the margins R of the two recording media P1, P2 shows a part of the single pattern image as the test image.

FIG. 4 illustrates an example in which two different pattern images (patterns A, B) are formed in the margin R of a single recording medium P (P3). That is, in FIG. 4, the margin R of the single recording medium P3 shows a combination of two different pattern images as the test image.

FIG. 5 illustrates an example in which two different pattern images (patterns A, B) are formed in the margin R of a recording medium P (P4), but one of the pattern images (pattern B) is divided and partly formed, and the remaining part of the divided pattern image (pattern B) and another different pattern image (pattern C) are formed in the margin of the subsequent recording medium P (P5).

Figure 6:
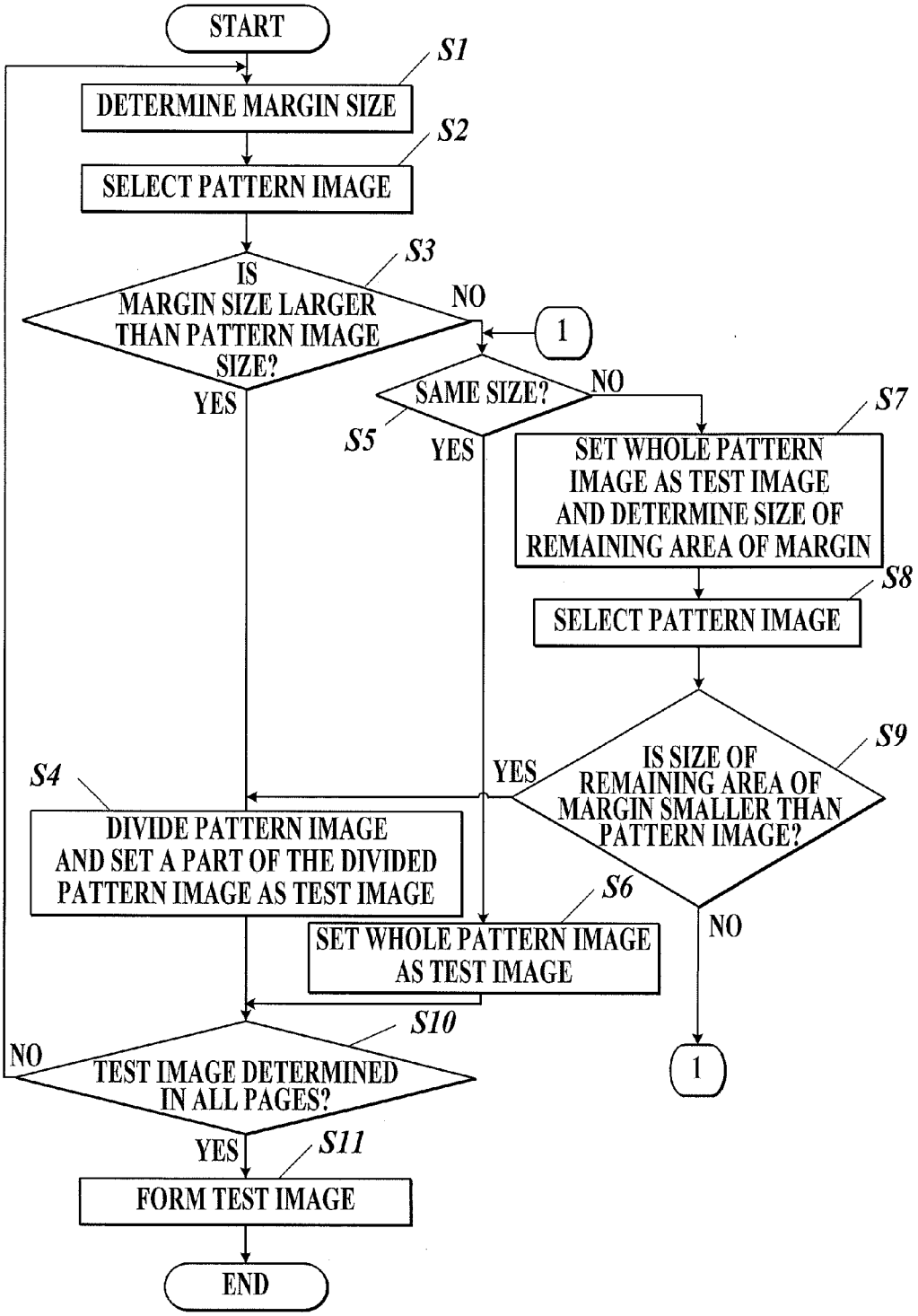
FIG. 6 is a flowchart illustrating test image formation processing.

In the following, the test image formation processing for forming such test images will be described referring to the flowchart of FIG. 6. The test image formation processing is performed in the control section 100. FIG. 6 illustrates the flowchart of forming the test image in one job. In the following description, the conveying direction of a recording medium P is denoted as the X direction, and the direction perpendicular to the conveying direction of the recording medium P is denoted as the Y direction.

First, in Step S1, the control section 100 determines the size of the margin R of the recording medium P.

Specifically, the control section 100 determines the size (lengths in the X and Y directions) of the margin R, which is the part of the recording medium P where the image is not formed, based on the information included in the job data such as the size of the recording medium P and the size and the position of the image forming area in the recording medium P.

Then, in Step S2, the control section 100 selects a predetermined pattern image (first pattern image) to be compared with the size of the margin R.

Specifically, the control section 100 selects a pattern image at the current number in a predetermined output order as the first pattern image from among different pattern images stored in the storage section 80.

When a pattern image has been divided and partly formed in the margin R of the previous recording medium P, the control section 100 selects the remaining part of the divided pattern image as the first pattern image in preference to the different pattern images stored in the storage section 80.

Then, in Step S3, the control section 100 makes a determination as to whether the size of the margin R is smaller than the size (lengths in the X and Y directions) of the predetermined pattern image (first pattern image).

Specifically, the control section 100 compares the size of the margin R determined in Step S1 with the size of the first pattern image selected in Step S2 so as to makes a determination as to whether the size of the margin R is smaller than the size of the first pattern image.

In the above Step S3, if it is determined that the size of the margin R is smaller than the size of the predetermined pattern image (first pattern image) (step S3, Yes), the processing continues with Step S4 where the control section 100 divides the predetermined pattern image (first pattern image) so as to obtain a part corresponding to the size of the margin R and sets the part of the divided pattern image as the test image to be formed in the margin R.

Specifically, the control section 100 sets a part of the image data of the predetermined pattern image (first pattern image) as the test image data of the test image to be formed in the margin R according to the size of the margin R. The rest of the image data that has not been set as the test image data is the image data of the remaining part of the divided pattern image.

Even when the first pattern image is the remaining part of a divided pattern image that has been partly formed in the margin R of the previous recording medium P, the control section 100 compares the size of the margin R with the size of the remaining part of the pattern image similarly and sets a part of the remaining part image data of the pattern image as the test image data according to the size of the margin R.

In Step S3, if the size of the margin R is equal to or larger than the size of the predetermined pattern image (first pattern image) (Step S3, No), the processing continues with Step S5 where the control section 100 makes a determination as to whether the size of the margin R is equal to the size of the predetermined pattern image (first pattern image).

Specifically, the control section 100 calculates the difference of the size of the predetermined pattern image (first pattern image) from the size of the margin R and makes a determination as to whether they have the same size based on whether the calculated value is 0.

If the size of the margin R is equal to the size of the predetermined pattern image (first pattern image) (Step S5, Yes), the processing continues with Step S6 where the control section 100 sets the whole predetermined pattern image (first pattern image) as the test image to be formed in the margin R.

If the size of the margin R is not equal to the size of the predetermined pattern image (first pattern image) (Step S5, No), the processing continues with Step S7 where the control section 100 sets the whole predetermined pattern image (first pattern image) as the test image to be formed in the margin R and also determines the size of the remaining area of the margin R.

Specifically, the control section 100 determines the difference of the size of the predetermined pattern image (first pattern image) from the size of the margin R as the size of the remaining area of the margin R.

Then, in Step S8, the control section 100 selects a pattern image (second pattern image) to be compared with the size of the remaining area of the margin R.

Specifically, the control section 100 selects the pattern image at the current number in the output order as the second pattern image from among the different pattern images stored in the storage section 80.

Then, in Step S9, the control section 100 makes a determination as to whether the size of the remaining area of the margin R is smaller than the size of the predetermined pattern image (second pattern image).

Specifically, the control section 100 compares the size of the remaining area of the margin R determined in Step S7 with the size of the second pattern image selected in Step S8 so as to makes a determination as to whether the size of the remaining area of the margin R is smaller than the second pattern image.

If the size of the remaining area of the margin R is smaller than the size of the predetermined pattern image (second pattern image) (Step S9, Yes), the processing continues with the above-described Step S4 where the control section 100 divides the predetermined pattern image (second pattern image) so as to obtain a part corresponding to the size of the remaining area of the margin R and sets the part of the divided pattern image as the test image to be formed in the remaining area of the margin R. Thereafter, the control section 100 performs the following steps similarly.

If the size of the remaining area of the margin R is equal to or larger than the size of the predetermined pattern image (second pattern image) (Step S9, No), the processing continues with the above-described step S5 where the controls section 100 makes a determination as to whether the size of the remaining area of the margin R is equal to the size of the predetermined pattern image (second pattern image). Thereafter, the control section 100 performs the following steps similarly.

After the above-described Step S4 or Step S6 is performed, the processing continues with Step S10 where the control section 100 makes a determination as to whether the determination of the test image is made in all pages of the recording medium P to be used for the job. If the determination of the test image is not made (Step S10, No), the processing returns to the above-described Step S1.

If the determination of the test image is made (Step S10, Yes), the processing continues with Step S11 where the control section 100 controls the image forming section 30 to form the test image on the recording medium P and then terminates the processing.

In the above-described Step S2, the pattern image may be selected according to the size of the margin R.

In this case, the size of the margin R determined in Step S1 is compared with the sizes of the different pattern images stored in the storage section 80 and the size of the remaining part of the divided pattern image that has been partly formed in the margin R of the previous recording medium P one after another, and a pattern image that has the closest size to the margin R is selected.

In this way, it is possible to avoid dividing a pattern image as much as possible when forming the test image.

In the above-described step S8, the pattern image may be selected according to the size of the remaining area of the margin R.

Also in this case, the size of the remaining area of the margin R is compared with the sizes of the different pattern images stored in the storage section 80 one after another, and a pattern image that has the closest size to the remaining area of the margin R is selected as the second pattern image.

In this way, even when the test image is formed from different pattern images, it is possible to avoid dividing the pattern images as much as possible when forming the test image.

As described above, the apparatus of this embodiment includes the image forming section 30 that forms an image on a recording medium P and the control section 100 that controls the image forming section 30 to form a test image for adjusting the image forming section 30 in the margin R of the recording medium P where the image is not formed, wherein the control section 100 determines the size of the margin R and forms a test image in the margin R corresponding to the size of the margin R.

With this configuration, the test image that fits the margin R is formed regardless of the size of the margin R. Therefore, the margin R of a recording medium P can be adequately used for forming a test image.

In this embodiment, the control section 100 compares the size of the margin R with the size of a predetermined pattern image. If it is determined that the size of the margin R is smaller than the size of the predetermined pattern image, the control section 100 divides the predetermined pattern image so as to obtain a part corresponding to the size of the margin R and forms the part of the divided predetermined pattern image in the margin R as the test image.

With this configuration, when the size of a margin R is smaller than the size of a predetermined pattern image, the predetermined pattern image is divided and partly formed in the margin R. Therefore, the margin R of a recording medium P can be adequately used for forming a test image.

In this embodiment, the control section 100 performs a control so that the remaining part of the divided predetermined pattern image is formed in the margin R of the subsequent recording medium P as the test image.

With this configuration, a single pattern image can be formed across a plurality of recording media P. Therefore, the margins R of recording media P can be effectively utilized. Further, the test image can be formed by using only the margins R of recording media P. Therefore, it is not required to stop ordinary image formation processing in order to form the test image, and the productivity can be maintained.

In this embodiment, the control section 100 includes the storage section 80 in which the different pattern images are stored. The control section 100 compares the size of the margin R with the size of the predetermined pattern image, and if it is determined that the size of the margin R is larger than the size of the predetermined pattern image, the control section 100 forms the predetermined pattern image and another pattern image other than the predetermined pattern image among the different pattern images stored in the storage section 80 in the margin R as the test image according to the size of the margin R.

With this configuration, when the size of a margin R is larger than the size of a predetermined pattern image, different pattern images can be formed in the margin R of the recording medium P. Therefore, the test image can be formed efficiently.

In this embodiment, the control section 100 divides at least one of pattern images to be formed in the margin R as the test image so as to obtain a part thereof with a predetermined size. The control section 100 then performs a control so that the part of the divided pattern image is formed in the margin R as the test image, and the remaining part of the divided pattern image is formed in the margin of the subsequent recording medium P as the test image.

With this configuration, even when different pattern images are formed in the margins R of recording media P, a predetermined pattern image is divided and formed in the margins R in parts according to the size of the margins R.

Therefore, the recording media P can be adequately utilized for forming the test image.

In this embodiment, the apparatus includes the storage section 80 in which the different pattern images are stored, and the control section 100 selects a pattern image as the test image to be formed in the margin R from among the different pattern images stored in the storage section 80 according to the size of the margin R.

With this configuration, a desirable pattern image can be selected from among the different pattern images according to the size of the margin R. Therefore, it is possible to avoid dividing a pattern image as much as possible.

In the embodiment, the image forming section 30 includes one or a plurality of recording head units 31 each including at least one recording head with nozzles, and the different pattern images stored in the storage section 80 are designed respectively for the recording head or the recording head units 31.

With this configuration, the pattern images that are designed for the respective recording head or for the respective recording head units 31 are formed in the margin R. Therefore, a faulty recording head or a faulty recording head unit 31 can be detected quickly.

While the present invention is specifically described based on an embodiment, the present invention is not limited to the above-described embodiment, and changes can be made without departing from the features of the present invention.

For example, the above-described embodiment illustrates an example in which the margin R is present in one end in the X direction of the recording medium P. However, it should be understood well that the position of the margin R is not limited thereto.

For example, the margin R may be present in both ends in the X direction of the recording medium P or in one or both ends in the Y direction of the recording medium P. Further, the margin R may be present in both ends in both X and Y directions of the recording medium P.

Figure 7:
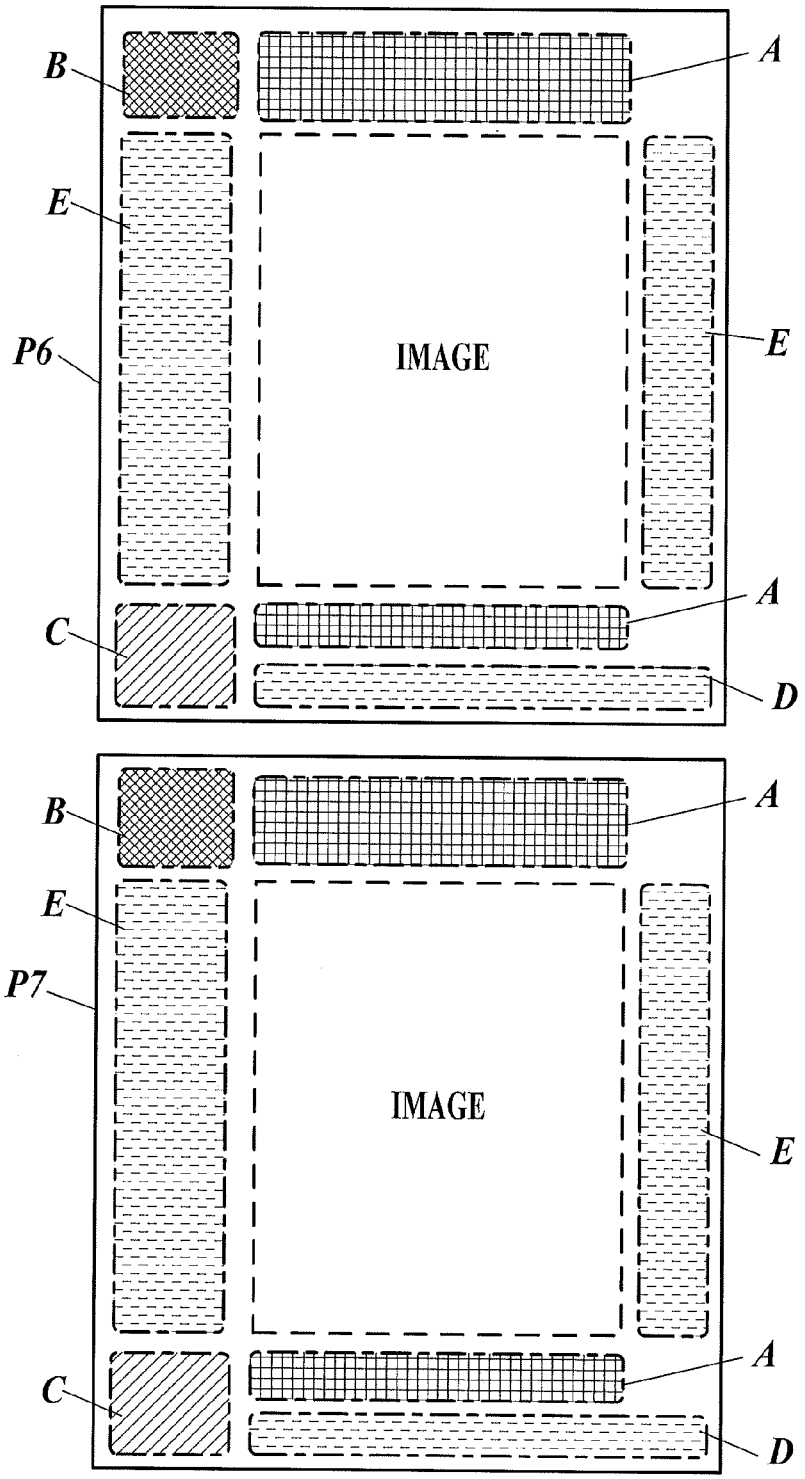
FIG. 7 illustrates an example of a recording medium on which a test image is formed.

For example, FIG. 7 illustrates an example in which the margins R are present in both ends in the X and Y directions of two recording media P (P6, P7), and five different pattern images (patterns A to E) are formed in the margins R as the test image.

When pattern images are formed in the margins R of recording media P as the test image, one or more of the pattern images may be selectively divided.

In this case, for example, the priority of the pattern images is set beforehand, and the control section 100 divides a predetermined pattern image so that a high-priority pattern image is formed in the first recording medium P.

Specifically, for example, patterns A and D in FIG. 7 are set as high-priority pattern images beforehand. In this case, it is possible to divide the pattern A into upper and lower parts and form them on the recording medium P6. However, when the pattern A is formed so, it becomes impossible to form the pattern D on the recording medium P6. Further, when the pattern images are formed in a similar arrangement in the next recording medium P7, the pattern D is formed late although it has high priority.

To cope with the problem, the lower part of the pattern A on the recording medium P6 is further divided, so that the pattern D is formed in the resultant vacant area and the remaining part of the pattern A is formed on the recording medium P7. As a result, while completion of the pattern A is late, the pattern D can be formed earlier.

It is also preferred that a second storage section is provided in which information on the recording head and the recording head units is stored, and the control section 100 selects a pattern image to be formed in the margin R as the test image from among the different pattern images stored in the storage section 80 according to the information stored in the second storage section.

The information on the recording head and the recording head units includes usage information such as powered hours and ink-jet count, nozzle failure (transition) information and the like.

The control section 100 references the information and can make a change so that a pattern image for a frequently used head or a pattern image for a head with a high failure rate is always formed first. As a result, for example, it is possible to differentiate the output frequency of pattern images between a head that has got 100 faulty nozzles in a hour and a head that has got 100 faulty nozzles in total in a half year.

With this configuration, the probability of promptly finding an image formation defect can be further improved.

It is also preferred that the control section 100 changes the size of the test image according to the size of the image forming area of the recording medium P.

Figure 8:
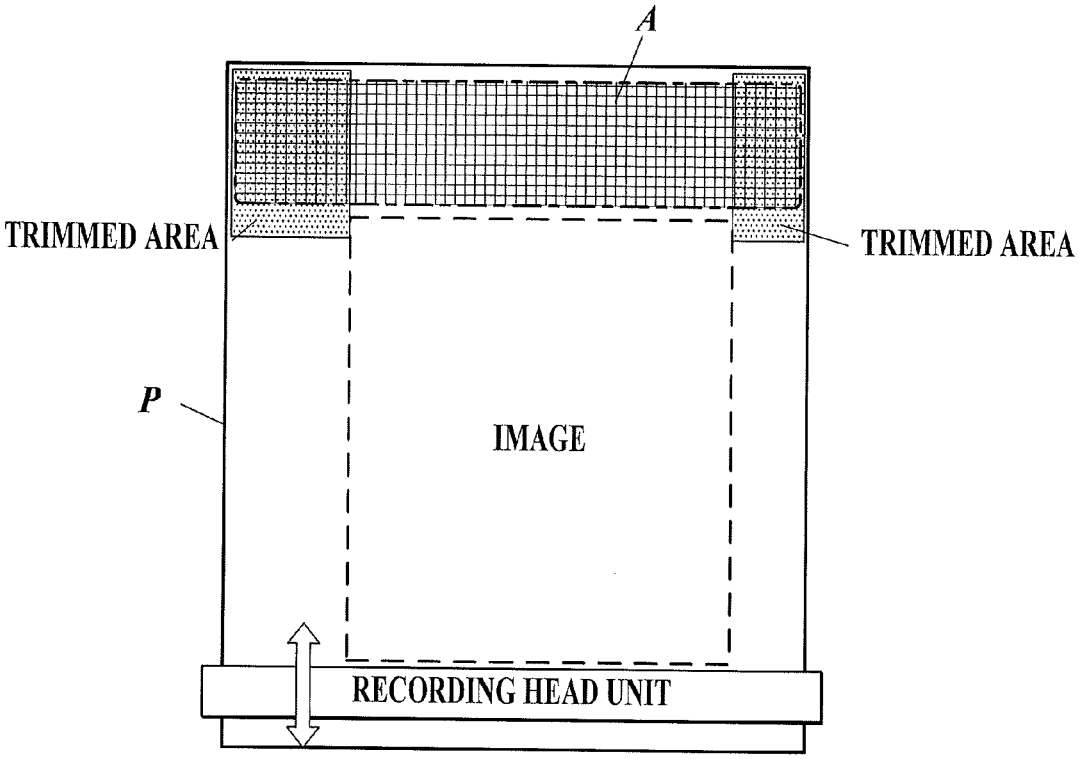
FIG. 8 illustrates an example of a recording medium on which a test image is formed, in which the size of the test image is changed according to an image forming area.

Specifically, after the control section 100 determines the test image to be formed on the recording medium P in Step S4 or Step S6, it trims the image data of the pattern image of the test image according to the size of the image forming area as illustrated in FIG. 8.

In this way, only the test image that is required for an image adjustment is formed.

It is also preferred that the control section 100 sets the test image according to the content of the image in the image forming area of the recording medium P.

Specifically, for example, the control section 100 specifies the color tone of the image to be formed in the image forming area based on the job data. In the above-described Step S2 and Step S8, the control section 100 selects a pattern image that is designed for a recording head or a recording head unit that jets the color ink to be used for forming the image so that it is output first. With this configuration, when the image to be formed in the image forming area is a single-color image for example, a pattern image related to the color is selected as the test image.

In this way, the necessary test image for an image adjustment is formed.

Furthermore, it is also preferred that the control section 100 changes the area of the test image that the reading section 50 reads according to the size of the image forming area of the recording medium P.

In this way, the test image is formed and read in the area corresponding to the used nozzles. Therefore, an image formation defect can be found efficiently.

INDUSTRIAL APPLICABILITY

The present invention is applicable to image forming apparatuses.

DESCRIPTION OF REFERENCE SIGNS

1 Image forming apparatus
10 Communicating section
20 Image processing section
30 Image forming section
31 Recording head unit
40 Irradiating section

50 Reading section
60 Conveyance section
70 Adjusting section
80 Storage section
90 Operation display section
100 Control section
P Recording medium
R Margin

The invention claimed is:

1. An image forming apparatus, comprising:

an image forming section which forms an image on a recording medium; and a control section which controls the image forming section to form a test image for an adjustment of the image forming section in a margin of the recording medium where the image is not formed, wherein the control section determines a size of the margin and forms the test image in the margin in a size corresponding to the size of the margin.

2. The image forming apparatus according to claim 1, wherein the control section compares the size of the margin with a size of a predetermined pattern image, and if the control section is determined that the size of the margin is smaller than the size of the predetermined pattern image, the control section divides the predetermined pattern image so as to obtain a part corresponding to the size of the margin and performs a control so that the part of the divided predetermined pattern image is formed in the margin as the test image.

3. The image forming apparatus according to claim 2, wherein the control section performs a control so that a remaining part of the divided predetermined pattern image is formed in a margin of a subsequent recording medium as the test image.

4. The image forming apparatus according to claim 1, further comprising:

a storage section in which different pattern images are stored, wherein the control section compares the size of the margin with a size of a predetermined pattern image, and if the control section is determined that the size of the margin is larger than the size of the predetermined pattern image, the control section selects the predetermined pattern image and another pattern image other than the predetermined pattern image from among the different pattern images stored in the storage section according to the size of the margin and forms the predetermined pattern image and the another pattern image in the margin as the test image.

5. The image forming apparatus according to claim 4, wherein the control section divides at least one pattern image of pattern images to be formed in the margin as the test image so as to obtain a part of a predetermined size and then performs a control so that the part of the divided pattern image is formed in the margin as the test image, and a remaining part of the divided pattern image is formed in a margin of a subsequent recording medium as the test image.

6. The image forming apparatus according to claim 1, further comprising:

a storage section in which different pattern images are stored, wherein the control section selects a pattern image to be formed in the margin as the test image from among the different pattern images stored in the storage section according to the size of the margin.

7. The image forming apparatus according to claim 4, wherein the image forming section comprises one or a plurality of recording head units each comprising at least one recording head with nozzles, and wherein the different pattern images respectively designed for the recording head or the recording head units are stored in the storage section.

8. The image forming apparatus according to claim 7, further comprising:

a second storage section which stores information on the recording head and the recording head units, wherein the control section determines the pattern image to be formed in the margin as the test image from among the different pattern images stored in the storage section according to the information.

9. The image forming apparatus according to claim 1, wherein the control section changes a size of the test image according to a size of an image forming area in the recording medium.

10. The image forming apparatus according to claim 1, wherein the control section determines the test image according to a content of the image to be formed in an image forming area in the recording medium.

11. The image forming apparatus according to claim 10, further comprising:

a reading section which reads the test image formed in the margin, wherein the reading section changes a reading area of the test image according to a size of the image forming area in the recording medium.

12. An image forming method, which is performed in an image forming apparatus comprising an image forming section configured to form an image on a recording medium, comprising:

a test image forming step of determining a size of a margin of the recording medium where the image is not formed and controlling the image forming section to form a test image for an adjustment of the image forming section in the margin in a size corresponding to the size of the margin.

* * * * *